US006131229A

United States Patent [19]

Lincuna et al.

[11] Patent Number: 6,131,229

[45] Date of Patent: Oct. 17, 2000

[54] PIPE CLEANING APPARATUS

[76] Inventors: Tom O. Lincuna; Thelma G. Lincuna, both of 94-575 Kahuanani St., Waipahu, Hi. 96797

[21] Appl. No.: 09/296,707

[22] Filed: Apr. 14, 1999

[51] Int. Cl.[7] ..... B08B 9/027

[52] U.S. Cl. ..... 15/104.33; 15/104.05; 15/104.31; 15/104.16

[58] Field of Search ..... 15/104.03, 104.05, 15/104.16, 104.2, 104.31, 104.32, 104.33; 254/134.3 FT; 231/2.1, 4

[56] References Cited

U.S. PATENT DOCUMENTS

| | | | |
|---|---|---|---|
| 1,051,992 | 2/1913 | Fisher et al. | 15/104.32 |
| 1,588,737 | 6/1926 | Hurd | 15/104.33 |
| 1,738,836 | 12/1929 | Lo Boves | 15/104.33 |
| 2,849,870 | 9/1958 | Silverman | 15/104.33 X |
| 2,968,352 | 1/1961 | Hene | 15/104.2 X |
| 5,765,251 | 6/1998 | Jones | 15/104.32 |
| 5,769,960 | 6/1998 | Nirmel | 15/104.33 X |
| 5,836,032 | 11/1998 | Hondo | 15/104.32 |

FOREIGN PATENT DOCUMENTS

| | | | |
|---|---|---|---|
| 74131 | 11/1944 | Czechoslovakia | 15/104.16 |
| 1087129 | 4/1984 | U.S.S.R. | 15/104.05 |
| 6521 | 3/1907 | United Kingdom | 15/104.33 |

*Primary Examiner*—Mark Spisich

[57] ABSTRACT

A rope includes a head at a first end, and a handle at a second end. The rope comprises wire strands within a flexible coating. The coating terminates before the head, exposing the strands at the head. The head is generally cone shaped, having a narrowest width at a distal end thereof. The distal ends of the strands at the head are each bent twice to form a hook.

8 Claims, 3 Drawing Sheets

PIPE CLEANING APPARATUS

BACKGROUND OF THE INVENTION

1. Field of the Invention

The present invention relates to tools, particularly to tools for cleaning out the inside of a pipe or drain.

2. Description of the Related Art

Every home owner knows that unclogging drains can be a difficult and time consuming process, and is not always successful. What is needed is a device which is uniquely configured to successfully remove clogs of various sizes from within a drain pipe.

SUMMARY OF THE INVENTION

The pipe cleaning apparatus of the present invention includes a rope having a head at a first end, and a handle at a second end. The rope comprises wire strands within a flexible plastic or rubber coating. The coating terminates before the head, exposing the strands at the head. The head is generally cone shaped, having a narrowest width at a distal end thereof. The distal ends of the strands at the head are bent to form hooks.

To use the invention, a person inserts the apparatus, head first, into a clogged drain pipe. The cone shaped head permits clogged material of various sizes to be caught between the head and the side walls of the pipe, impinging the material on the strands. Twisting, pushing, and pulling the apparatus will help to catch and retain material within the bends of the strands.

Still further features and advantages will become apparent from the ensuing description and drawings.

DETAILED DESCRIPTION

Figure 1:
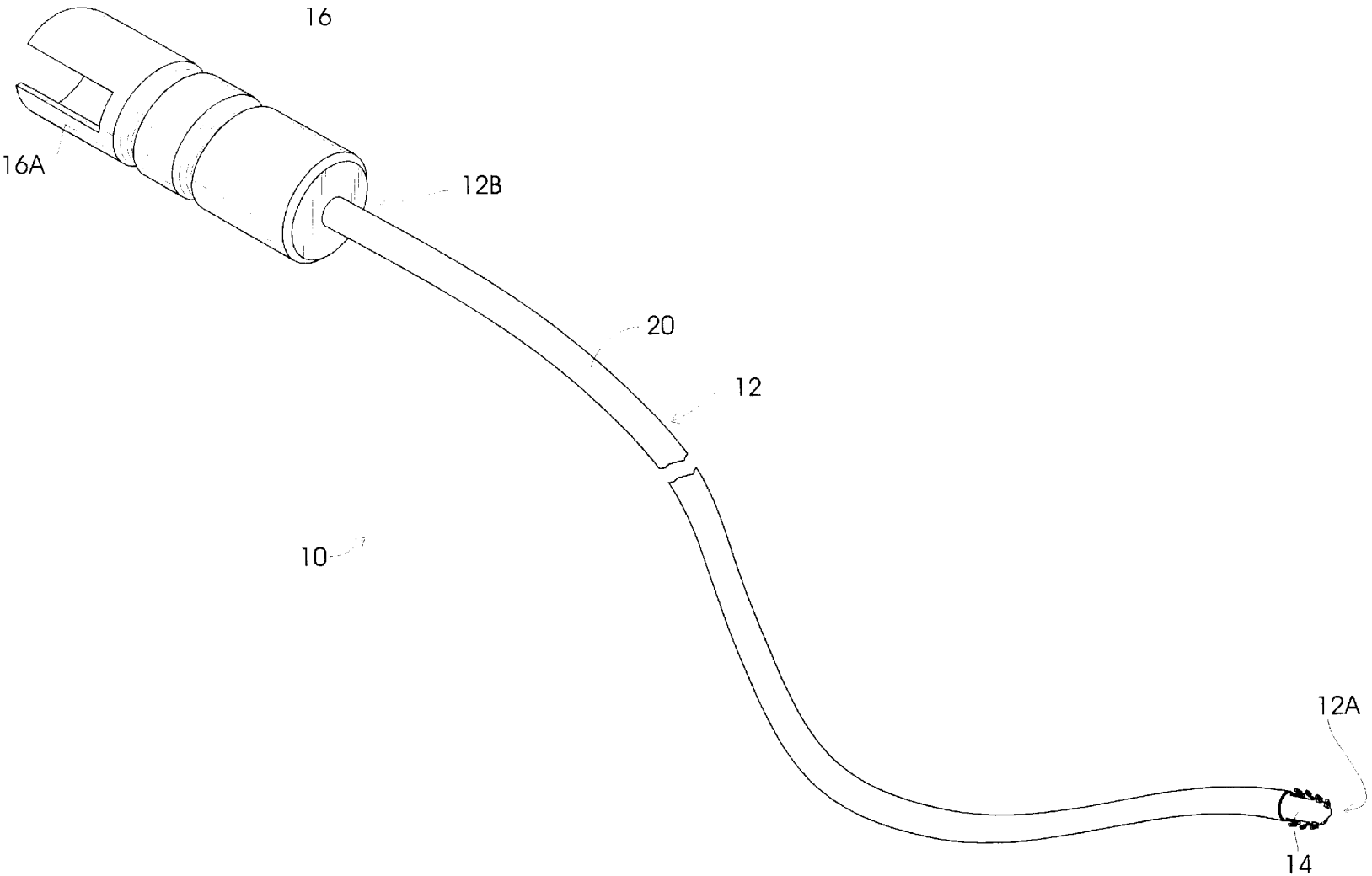
FIG. 1 is a perspective view of a pipe cleaning apparatus of the present invention.

FIG. 1 is a perspective view of a pipe cleaning apparatus 10 of the present invention. The apparatus 10 comprises a plastic or rubber coated wire rope 12. The rope 12 includes a head 14 at a first end 12A, and a handle 16 at a second end 12B.

Figure 1A:
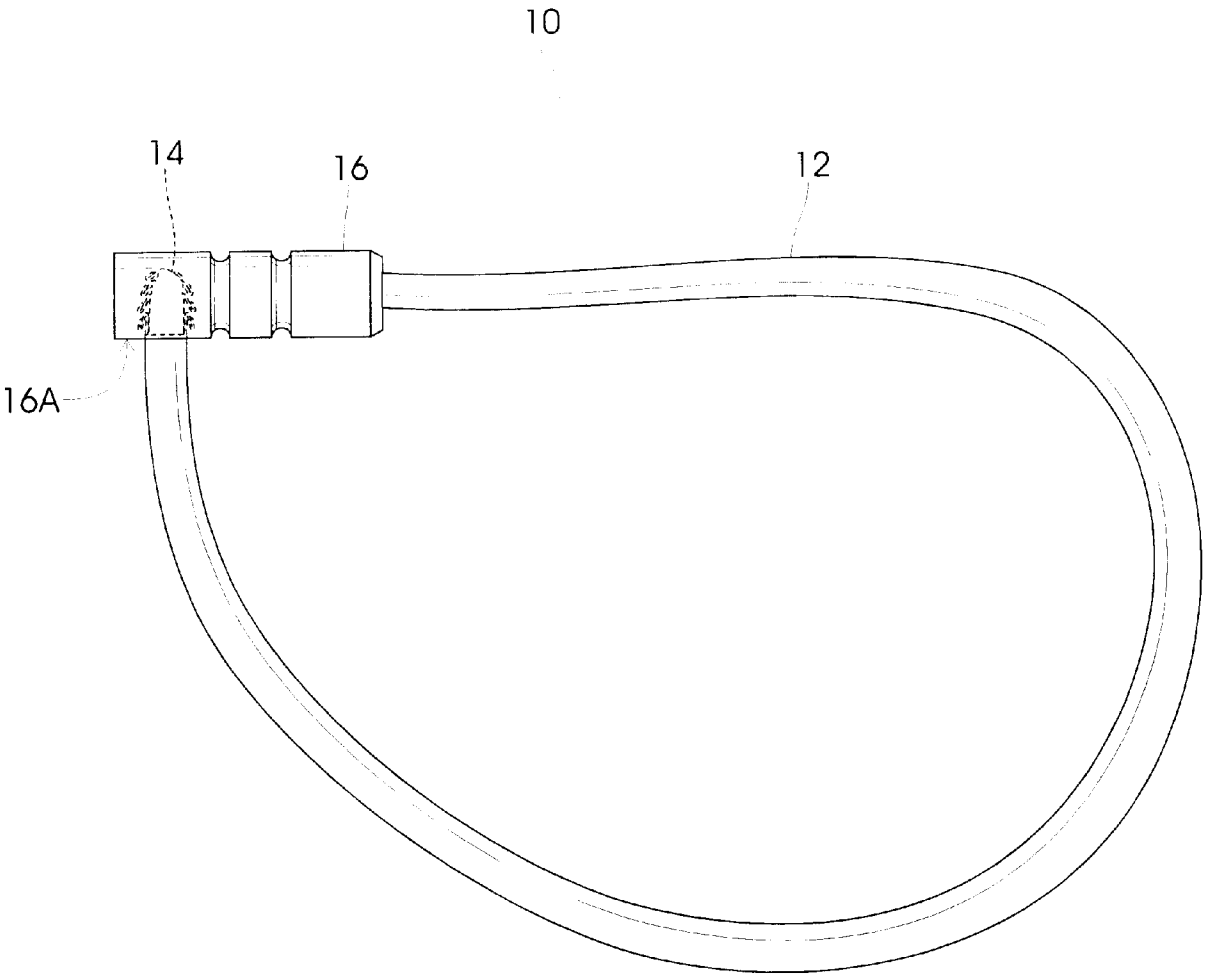
FIG. 1A is an elevational view of the pipe cleaning apparatus in a second position.

FIG. 1A is a view of the pipe cleaning apparatus 10 in a second position. Referring to FIGS. 1 and 1A, the handle 16 is at least partially hollow as shown, and includes a slot 16A therein, through which the rope 12 can be inserted, to protect the head 14.

Figure 2A:
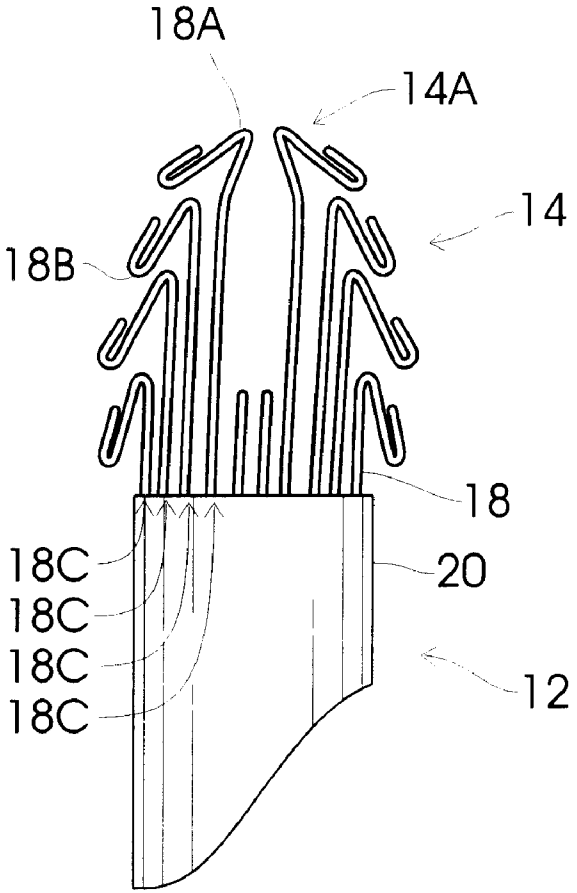
FIG. 2A is a cross-sectional view of the head.
Figure 2:
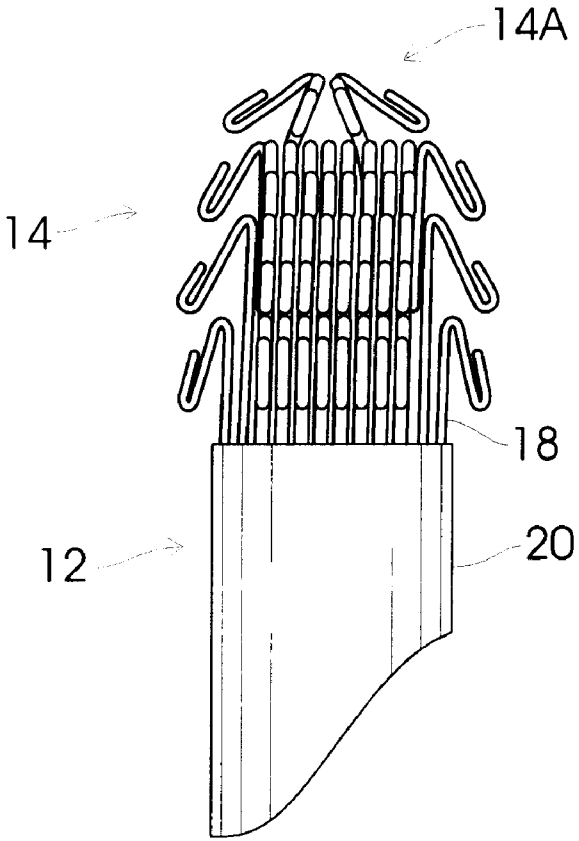
FIG. 2 is an enlarged elevational view of a head of the apparatus.

FIG. 2 is an enlarged elevational view of the head 14 of the apparatus 10. The rope 12 comprises wire strands 18 within a coating 20. The coating 20 terminates before the head 14, exposing the strands 18 at the head 14. The head 14 is generally cone shaped, and symmetrical about a central longitudinal axis thereof. The head 14 has a narrowest width at a distal end 14A thereof. Note that FIG. 1 shows the head 14 in less detail than FIG. 2, due to the smaller scale of FIG. 1.

FIG. 2A is a cross-sectional view of the head 14. Generally only a single line of the strands 18 is shown, for clarity.

Referring to FIGS. 2 and 2A, all of the strands 18 except a group of center-most strands 18 are bent twice at the head 14 as shown. A first bend 18A directs the strand 18 away from the distal end 14A of the head, and a second bend 18B directs the strand 18 back toward the distal end 14A of the head. The strands 18 are bent such that each layer 18C of strands partially covers an adjacent, more outwardly positioned layer 18C of strands 18.

The center-most strands 18 are shorter than the strands 18 which surround the center-most strands 18, and are unbent. This permits inward flexing of the bent strands 18 toward the center of the head 14. The strands 18 which immediately surround the center-most strands 18 are bent inward to facilitate the inward flexing of the strands 18, and to cover the gap created by the shorter center-most strands 18.

To use the invention, a user (not shown) inserts the apparatus 10, head 14 first, into a clogged drain pipe (not shown). The cone shaped head 14 permits clogged material (not shown) of various sizes to be caught between the head 14 and side walls of the pipe, impinging the material on the strands 18. Twisting, pushing, and pulling the apparatus 10 will help to catch and retain material between the strands 18 and between portions of individual strands 18. The inward flexing of the head 14, and subsequent springing back outward, permits a tight fit of the head 14 into the pipe, improving the material catching action of the head 14.

From the foregoing description, many variations will be apparent to those skilled in the art that would be encompassed by the spirit and scope of the invention. For example, although it is preferred to apply a plastic or rubber coating to the wire strands, one may choose to instead bundle the wire strands together tightly within a flexible plastic or rubber sheath. Accordingly, the scope of the invention is to be limited only by the following claims and their legal equivalents.

What is claimed is:

1. A pipe cleaning apparatus comprises:

a. a rope having a head at a first end thereof;

b. said rope comprising wire strands within a covering;

c. said covering terminating before said head, exposing said wire strands at said head;

d. each of said wire strands forming a hook at said head;

e. a handle formed at a second end of said rope; wherein said handle is hollow and includes a slot through which said head of said rope can be inserted.

2. The pipe cleaning apparatus of claim 1, wherein the head is generally cone shaped, having a narrowest width at a distal end thereof.

3. A pipe cleaning apparatus comprising:

a. a rope having a head at a first end thereof, and a handle at a second end thereof;

b. the rope comprising wound wire strands within a covering;

c. the covering terminating before the head, exposing the strands at the head;

d. the head being generally cone shaped, having a narrowest width at a distal end thereof; and e. a plurality of the strands having a first bend at the head, directing the strand away from the distal end of the head, and a second bend between the first bend and a distal end of the strand, directing the strand generally toward the distal end of the head.

4. The pipe cleaning apparatus of claim 3, wherein a center-most group of the strands are shorter than surrounding ones of the strands, and are unbent.

5. The pipe cleaning apparatus of claim 4, wherein the strands which immediately surround the center-most group of the strands each have a third bend between the first bend thereof and the covering, which turns the strand inwardly generally toward a central longitudinal axis of the head.

6. A pipe cleaning apparatus comprising:

a. a rope having a head at a first end thereof;

b. the head comprising wire strands;

c. the head being generally cone shaped, having a narrowest width at a distal end thereof; and d. a plurality of the strands having a first bend at the head, directing the strand away from the distal end of the head, and a second bend between the first bend and a distal end of the strand, directing the strand generally toward the distal end of the head.

7. The pipe cleaning apparatus of claim 6, wherein a center-most group of the strands are shorter than surrounding ones of the strands, and are unbent.

8. The pipe cleaning apparatus of claim 7, wherein the strands which immediately surround the center-most group of the strands each have a third bend which turns the strand inward generally toward a central longitudinal axis of the head.

* * * * *